United States Patent [19]

Griset, Jr.

[11] 4,226,076

[45] Oct. 7, 1980

[54] APPARATUS AND PROCESS FOR PRODUCING A COVERED ELASTIC COMPOSITE YARN

[75] Inventor: Ernest J. Griset, Jr., Asheville, N.C.

[73] Assignee: Akzona Incorporated, Asheville, N.C.

[21] Appl. No.: 965,774

[22] Filed: Dec. 4, 1978

[51] Int. Cl.[3] ..... D02G 3/32

[52] U.S. Cl. ..... 57/12; 57/226

[58] Field of Search ..... 57/12, 3, 6, 225–228

[56] References Cited

U.S. PATENT DOCUMENTS

| | | | |
|---|---|---|---|
| 2,263,612 | 11/1941 | Chittenden | 57/12 |
| 2,354,449 | 7/1944 | Alderfer | 57/12 |
| 2,804,745 | 9/1957 | Foster | 57/12 X |
| 3,011,302 | 12/1961 | Rupprecht | 57/12 X |
| 3,166,885 | 1/1965 | Bridgemal et al. | 57/226 |
| 3,234,725 | 2/1966 | Storti | 57/12 |
| 3,303,640 | 2/1967 | Reid et al. | 57/12 |
| 3,365,875 | 1/1968 | Hall | 57/12 X |
| 3,657,873 | 4/1972 | Gibson et al. | 57/12 X |
| 3,991,551 | 11/1976 | Petree | 57/12 X |

*Primary Examiner*—John Petrakes

*Attorney, Agent, or Firm*—Craig & Antonelli

[57] ABSTRACT

A process and apparatus for covering elastic single strand core yarns with a plurality of inelastic cover yarns, such as nylon, is provided. The core yarn is stretched in a controlled manner between a set of feeder rolls and a pair of drawing rolls. Intermediate the feeder and drawing rolls, a thread guide is provided for accommodating the interlacing of a plurality of cover yarn strands with the single strand core yarn passing therethrough. The cover yarn and core yarn are further intertwined with one another at a nip formed at the drawing rolls by way of a slight twisting action applied thereto via a take-up spindle for the resulting composite yarn disposed downstream of the drawing rolls.

21 Claims, 1 Drawing Figure

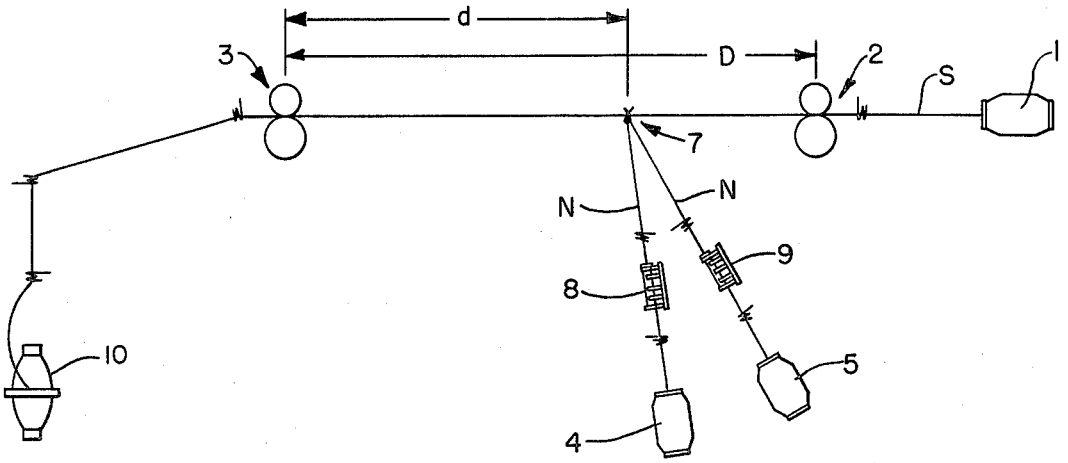
d
D
3
2
S
1
7
N
N
9
8
10
5
4

APPARATUS AND PROCESS FOR PRODUCING A COVERED ELASTIC COMPOSITE YARN

BACKGROUND OF THE INVENTION

The present invention relates to improved apparatus and process for forming composite yarns having a central elastomeric or elastic core yarn covered by relatively inelastic cover yarns, the utility and advantages of such composite elastic yarns has been recognized for some time in the textile industry. Such composite yarns provide the advantages of the covering yarn with respect to surface effects, while retaining the extension characteristics of the elastic core yarn during and after fabrication of clothing. Such composite yarns are more capable of withstanding the tension inherent in fabrication and in wearing of cloths made therefrom, than would be the case were the entire yarn made of the inelastic cover yarn.

Numerous prior art methods and apparatus have been proposed for forming composite yarns of the general type contemplated by the present invention. U.S. Pat. No. 3,940,917 to Strachan relates to a composite elastic yarn and process for producing same which involves the stretching of the elastic core yarn, while applying a plurality of inelastic filaments with pressurized fluid entangling means to cover the core yarn. While this arrangement utilizing compressed air to entangle the inelastic cover filaments around the elastic core yarn provides for relatively high speed production of the composite yarn, this arrangement does require substantial expenditures for the compressed air entangling apparatus, which must be constructed with close tolerances in order to carry out the desired tangling characteristics. Also, there is a tendency for the compressed air jets to become jammed up with the yarn, with consequent operational difficulties. U.S. Pat. Nos. 3,078,653 and 3,078,654 to Marshall, disclose systems for manufacturing wrapped elastic yarn, which also utilize a pressurized fluid to aid in the entangling of the inelastic cover material with the elastic core material, which systems also exhibit the above-noted disadvantages of the Strachan system.

U.S. Pat. No. 3,921,382 to Tsujita et al. relates to a method of making a composite covered elastic yarn wherein a multi-filament continuous filament thread is wrapped as a sheath yarn around an elastic core yarn and wherein a false twisting spindle is provided downstream of a heating element for applying a false twist to the composite yarn during the formation thereof. This Tsujita et al. system requires that a twisting spindle and heat setting arrangement be provided for applying the false twist to the composite yarn as it is being produced, thereby requiring the additional expenditures for such false twisting spindle and heating apparatus, not to mention the mechanisms for controlling the tolerances of the false twisting steps. U.S. Pat. No. 3,691,750 also relates to a composite core yarn formed of false twist textured yarns, wherein both the core yarn and the wrapper yarn are false twist textured during formation of the composite core yarn.

U.S. Pat. No. 3,158,985 to Spicer relates to a composite textile yarn and method of making same which includes subjecting the yarn to moist steam under controlled conditions to aid in the formation of the composite yarn. U.S. Pat. No. 3,382,662 to Seelig et al. relates to covered elastomeric yarns which utilize an adhesive layer between the core yarn and the coverng yarn.

These last-mentioned arrangements necessarily involve manufacturing expenditures and problems with respect to providing the respective steam conditions, and the adhesive application.

U.S. Pat. No. 3,657,873 to Gibson et al. relates to an arrangement for the formation of a composite elastic yarn with non-elastic cover yarns that are pretextured or false twisted. In this arrangement, the non-elastic yarns and the elastic yarns are first joined at a pair of drawing rollers where the non-elastic yarn twists about the elastic yarn. In this Gibson et al. patent arrangement, the elastic spandex yarn is tensioned sufficiently to provide a predictable contractural force and predictable limit of contraction in the composite yarn. This tension is disclosed as being 16 grams during the joining of the elastic yarn with the non-elastic yarn at the drawing rollers.

It has been found that the composite yarn product obtained by the procedure and apparatus shown in the Gibson et al. patent is unsatisfactory for use as hosiery yarn because the cover yarns will not wrap around the elastic yarn sufficiently and tend to separate from the elastic yarn.

SUMMARY OF THE INVENTION

The present invention provides an apparatus and a method for making an elastic composite yarn without requiring false twisting of the yarn components during formation of the composite yarn, and without the need for compressed air or fluid entangling means, while still maintaining high speed production of the composite yarns at a minimum of cost. In view of the large market for hosiery and the like using such composite yarns, it will be understood that any increases in efficiency or reduction in cost of production will have a substantial impact upon the profitability of the manufacturing operation. With the present invention, single strand elastic yarn, preferably spandex, (spandex is a manufactured fiber in which the fiber-forming substance is a long chain synthetic polymer comprised of at least 85% of a segmented polyurethane) and a plurality of strands of textured (previously false twisted) polyester, nylon or the like yarn are used as the covering yarn. Since such textured yarns are readily available, utilization of these yarns simplifies the manufacturing of the composite yarn by dispensing with the need for false twist spindles and the like.

The present invention is directed to an improved method and apparatus, which overcome the disadvantages of the prior art. According to one important feature of the present invention, the textured cover yarns are joined with the elastic core yarn via a thread guide positioned upstream of a pair of drawing rolls, as contrasted with the above-noted Gibson et al. patent arrangement wherein no such thread guide is provided. This feature provides for greatly improved alignment of the cover yarns with the elastic core yarn as these yarns pass through the drawing rollers, thereby providing for a very consistent and reliable tangling or intertwining of the cover yarns about the core yarn. According to another important feature of the invention, the tension in the core yarn is controlled to provide in excess of 200% elongation of the core yarn during the composite yarn formation. This degree of elongation further insures that the cover yarns will intertwine closely around the core yarn and will not easily separate in the relaxed state of the composite yarn. Also, this degree of elongation provides a composite yarn product that is especially suitable for the manufacture of hosiery, e.g. as support stockings.

In accordance with a particularly preferred arrangement of the present invention, the elastomeric core yarn is placed under tension between a pair of feeder rolls and a pair of drawing rolls. A thread guide is provided intermediate the feeder and drawing rolls for guiding and for joining the elastic core yarn with the non-elastic cover yarns and a further twisting of the cover yarns about the core yarn is effected in a simple manner at the drawing rolls with the aid of a take-up spindle downstream of the drawing rolls. With this arrangement of the present invention, there is no need to provide any complex compressed air entangling systems, and it has been found that the further slight twisting of the cover yarns about the core yarn by way of the drawing roller and the take-up spindle results in continuous rapid production of a high quality composite yarn with the composite yarn so produced exhibiting good appearance and elastic performance characteristics. The joining of the textured cover yarns and the core yarn at the thread guide arranged upstream of the drawing rollers insures a reliable and consistent geometrical covering arrangement of the cover yarns alongside the core yarn as they pass through the drawing rollers and prevents separation of the cover yarns from the core yarn.

In particularly preferred embodiments, the elastic core yarn utilized with the present invention is spandex and the cover yarns are formed of stretch textured polyester or nylon. It will be appreciated that other yarns may be used for the elastic core yarn and that other synthetic fiber-forming polymers may be used to form the cover yarns.

The cover yarns are stretch textured yarns having a high false twist induced therein, i.e. on the order of from 150 to 200 turns per inch to provide the high torque required to effect intertwining of the cover yarns on the core yarn. When nylon is utilized, the yarn is textured by twisting, heating and then removing the twist.

These and further objects, features and advantages of the present invention will become more apparent from the following description when taken in connection with the accompanying drawings, which show, for purposes of illustration only, a single embodiment in accordance with the present invention.

BRIEF DESCRIPTION OF THE DRAWINGS

The single drawing FIGURE is a schematic side view illustrating the apparatus and process for forming composite yarns in accordance with a preferred embodiment of the present invention.

DETAILED DESCRIPTION OF THE DRAWINGS

Referring to the single drawing FIGURE, an elastomeric spandex core yarn S is fed from a supply reel 1 to a pair of feed rolls 2. Downstream of the pair of feed rolls 2, a pair of drawing rolls 3 is provided, which rolls 3 operate at a different rotational velocity so as to apply tension to the core yarn S in a controlled manner. In preferred embodiments, the control stretch of the core yarn S by the feed rolls 2 and drawing rolls 3 is greater than 200%, with 350% being a particularly preferred degree of stretch of the core yarn S.

Reels 4 and 5 contain supplies of stretch textured cover nylon yarns N which are to be combined with the core yarn S. These yarns exhibit a high degree of torque due to the prior texturing thereof with false twisting on the order of 150 to 200 turns per inch with either a Z or S twist. To effect the continuous covering of the core yarn S with the nylon covering yarns N, a thread guide 7 is disposed intermediate the roll pairs 2, 3, through which thread guide 7 the core yarn S passes, together with the cover yarns N supplied from the reels 4 and 5 via tensioning units 8 and 9. (These tensioning units provide a light tension to the cover yarns.) The core yarn S and the covering yarns N are therefore interlaced as the yarns travel between the position of the thread guide 7 and the drawing rolls 3. In particularly preferred embodiments, the distance D between the rolls 2 and 3 is at least 10 inches and as much as 36 inches, with the distance d between thread guide 7 and rolls 3 being at least 2 inches, with from 4 inches to 12 inches being a good range.

It will be understood that the distance between the pair of drawing rolls and the thread guide is critical for achieving the required covering of the core yarn. If the distance is less than 2 inches, the cover yarns tend to separate from the core yarn during subsequent processing such as knitting, etc. Also the appearance of the composite yarn is unacceptable due, in part, to the uneven covering of the cover yarns. After 12 inches the improvement in the covering effect is not appreciable and too much space is being taken up between the rolls.

The distance between the feeder rolls and the thread guide is primarily determined by the geometry of the existing apparatus, i.e. the distance between the feeder and drawing rolls. It should also be recognized from the accompanying drawing that the thread guide 7 is arranged directly between the feeder rolls 2 and the drawing rolls 3 so that the elastic yarns can be stretched out linearly between the rolls.

Downstream of the drawing rolls 3, a take-up spindle 10 is provided, which is rotated so as to apply a slight twist (i.e. from 0.25 to 10 turns per inch) to the composite yarn as it passes through the drawing rollers, whereby the covering yarns N are twisted and further tangled about the core yarn S in a continuous manner without the necessity of additional tangling apparatus. The twist applied by the take-up spindle 8 backs up to the drawing rolls 3. The speed of the take-up spindle is controlled to apply sufficient tension to the composite yarn to insure that no loops form in the cover yarns. Too much tension will, however, break the core yarn. With a 40 denier spandex core, 15–25 grams tension is applied; with 70 denier spandex core, 45 to 55 grams. It will be appreciated that the yarns may be given the same or different twist directions and for the manufacture of hosiery and wearing apparel usually have a low denier on the order of from 5 to 40 with a filament count of from 3 to 12. The lower denier yarns have a higher degree of false twist to provide the desired textured effect. The core yarn usually is a monofilament with a higher denier ranging from 20 to 100. The monofilaments may have a trilobal cross-section; such as Glospan or a circular cross-section such as Lycra; the trilobal configuration is preferred since it appears to provide better tangling with the cover yarns.

With the simple arrangement of the present invention, the manufacture of the composite yarn is done at relatively low cost, with relaibility, and at relatively high speeds, e.g. from 200 to 500 or more yards per minute. Also of great importance, the composite yarn formed by the apparatus and method of the present invention exhibits very good surface appearance characteristics, as well as good elastic characteristics, features required for the manufacture of ladies' hosiery and the like.

The following examples utilizing the apparatus and method according to the present invention further show the advantages of the present invention.

EXAMPLE 1

Using the apparatus arrangement shown in the drawings, several composite yarns were produced from 40 denier Glospan-spandex core yarn and two cover yarns of stretch nylon having a denier of 12 and a filament count of 6. In some runs, both cover yarns used had the same twist, i.e. S or Z, and in other runs the cover yarns each had a different twist; all had been textured by false twisting with 170 turns per inch. The speed of the composite yarn formation was either 250 or 500 yards per minute. The tensioning units applied 1 gram of tension to each of the nylon cover yarns and the feeder rolls were spaced from the drawing rolls by a distance of 28" with the thread guide being spaced 12" from the drawing rolls. The rotational speeds of the feeder rolls and the drawing rolls were controlled to apply a draw ratio of 3.5:1 to the elastic core yarn with a tension of 6 grams. The take-up spindle applied a twist of 1.1 turns per inch (tpi) at the production rate of 250 ypm and a twist of 0.55 tpi at the rate of 500 ypm, with the tension being from 15–20 grams. All yarns produced had an acceptable appearance and exhibited no tendency for the cover yarns to separate from the core yarn.

EXAMPLE 2

Six (6) samples of the composite yarns manufactured by the apparatus and the procedure set forth in Example 1 were utilized in knitting womens' pantyhose. Each of these samples were knitted as the alternative course with 20/5 S.D. Untextured Enka Nylon yarn, Merge 7612, on the Reading Mark IV four-feed ladies' pantyhose machine. The pantyhose portion was produced from 40/10 yarn made by combining two ends of 20/5 Mark XI-A textured nylon yarns. No difficulties were experienced in knitting any of these samples, and sufficient yarn was available to produce a controlled greige measurement in all stockings. These measurements were: panty—16"; knee—15½"; ankle—11½". A plain stitch construction was used for all stockings. Normal dyeing and finishing procedures were used, and boarding was carried out in order to facilitate examination of the fabrics. Each of the samples was evaluated for finish stretch, and also a subjective evaluation of appearance in stretch was carried out, with samples of all the stockings being placed on forms.

Stockings are stretched width ways with a "Stretchet" machine which measures in inches of stretch with a 7 lb. weight. The standard control and the composite yarn sample hose were stretched in greige before dyeing at: knee—16½"; ankle—12¾".

The table below shows the control and composite yarn samples in inches of stretch as a comparison of finished hose. The control was made from a conventionally covered Glospan Spandex (i.e. wherein the two cover yarns are twisted together at 10 tpi and then wrapped around the core yarn). All measurements are shown in inches.

The table also identified each of the six (6) samples, the speed at which the composite yarn was formed, the core yarn material utilized, the covering yarn material utilized, and the finished stretch of the hose manufactured with the respective composite yarn under the conditions noted above.

| Sample No. | Speed of Composite Yarn Formation | Core Yarn | Covering Yarn (all Nylon) | Finish Stretch Characteristics of Hose Produced with Composite Yarn | | | |
|---|---|---|---|---|---|---|---|
| | | | | Knee | Ankle | Foot | Length |
| 1 | 250 YPM | 40 denier Glospan-Spandex | 2 × 12/6 Textured S | 12 | 9 | 8¾ | 104 |
| 2 | 500 YPM | 40 denier Glospan-Spandex | 2 × 12/6 Textured S | 12¼ | 9⅛ | 8⅞ | 107 |
| 3 | 250 yPM | 40 denier Glospan-Spandex | 2 × 12/6 Textured Z | 12⅜ | 9⅛ | 8⅞ | 106 |
| 4 | 500 YMP | 40 denier Glospan-Spandex | 2 × 12/6 Textured Z | 12¼ | 9⅛ | 9 | 108 |
| 5 | 250 YPM | 40 denier Glospan-Spandex | 12/6 Textured S + 12/6 Textured Z | 12 | 8⅞ | 8⅝ | 101 |
| 6 | 500 YPM | 40 denier Glospan-Spandex | 12/6 Textured S + 12/6 Textured Z | 12½ | 9 | 9 | 103 |
| Control | 10 YPM | 40 denier | 2 × 12/6 Textured S | 13⅛ | 9¼ | 9⅜ | 107 |

From the table, it can be observed that the hose produced from the samples utilizing opposite twist covering yarns are the shortest with normal width stretch. The hose made using the "Z" twist components are the widest and longest in the evaluation. It appears that twist direction and the combination of covering yarns affects the hosiery stretch. All stockings produced from the composite yarn product of this invention have an acceptable appearance on the leg of the wearer and provide satisfactory support. It is evident also that the stretch characteristics are comparable to the control which is produced at much slower speed.

While I have shown and described various embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

What is claimed is:

1. In a process for covering an elastic core yarn with inelastic textured cover yarns, the steps comprising:

continuously supplying an elastic core yarn to feeder means;

applying a controlled stretch to said core yarn by passing the yarn between a pair of drawing rolls arranged downstream of said feeder means;

intertwining at least two strands of textured cover yarn with said core yarn by passing the cover yarns and the core yarn through a thread guide disposed intermediate said feeder means and said drawing rolls, and further intertwining said cover yarns with said core yarn by applying twist thereto downstream of said drawing rolls.

2. A process according to claim 1, wherein said feeder means includes a pair of feeder rolls which clampingly engage said elastic core yarn.

3. A process according to claim 2, wherein said applying of said control stretch is applied sufficiently to stretch said core yarn to at least 200% of its unstretched condition.

4. A process according to claim 2, wherein said feeder rolls rotate at a speed slower than the speed of said drawing rolls to effect stretching of said core yarn.

5. A process according to claim 2, wherein said thread guide is positioned at a predetermined distance from said pair of drawing rolls.

6. A process according to claim 2, wherein said thread guide is positioned at least 2 inches from said drawing rolls.

7. A process according to claim 2, wherein said cover yarns are each formed of a textured polyester yarn.

8. A process according to claim 2, wherein said cover yarns are each formed of textured nylon yarn.

9. A process according to claim 2, wherein said textured cover yarns are each a false twist yarn that has been twisted on the order of from 150 to 200 turns per inch during texturing.

10. A process according to claim 2, wherein said core yarn is stretched by approximately 350% between said pair of feed rollers and said pair of drawing rollers.

11. A process according to claim 2, wherein said thread guide is positioned from said drawing rolls at a distance from 2 to 12 inches and the feeder rolls are spaced from the drawing rolls by a distance of at least 10 inches, said thread guide being in a stationary position.

12. A process according to claim 11, wherein said distance between the feeder rolls and the drawing rolls is from 10 inches to 36 inches.

13. A process according to claim 1, wherein intertwining of said cover yarns with said core yarns is effected by a take-up spindle which produces a composite yarn comprised of said core yarn intertwined with said cover yarns at a rate of from 200 to 500 yards per minute.

14. An apparatus for covering an elastic core yarn with inelastic textured cover yarns comprising:

feeder means for supplying a core yarn at a first predetermined rate;

a pair of drawing rolls arranged downstream of said feeder means for withdrawing the core yarn from said feeder means at a second predetermined rate which is greater than the first predetermined rate, to thereby stretch the core yarn in a controlled manner;

thread guide means disposed intermediate said feeder means and said drawing rolls for guiding said core yarn and at least two textured cover yarns along a preselected linear path so the cover yarns will intertwine with each other and said core yarn and form a composite yarn before entering between said pair of drawing rolls; and means disposed downstream of said drawing rolls, for applying twist to said composite yarn as it passes through said drawing rolls, whereby said cover yarns are twisted about said core yarn.

15. An apparatus according to claim 14, wherein said feeder means includes a pair of feeder rolls which clampingly engage said elastic core yarn.

16. An apparatus according to claim 15, further comprising means for controlling the speed of said feeder rolls and the speed of said drawing rolls so that said core yarn is stretched to at least 200% of its unstretched condition.

17. An apparatus according to claim 15, wherein said thread guide means is disposed at a preselected distance from said drawing rolls, said distance being sufficient to insure that the cover yarns intertwine with each other and with said core yarn before entering between said drawing rolls.

18. An apparatus according to claim 15, wherein said guide means is a pigtail guide disposed at a distance of at least 2 inches from said drawing rolls, said guide being in a stationary position.

19. An apparatus according to claim 18, wherein said thread guide means is disposed at a distance of from 2 to 12 inches from said drawing rolls and the distance between the feeder rolls and the drawing rolls is at least 10 inches.

20. An apparatus according to claim 19, wherein the distance between the feeder rolls and the drawing rolls is from 10 to 36 inches.

21. An apparatus according to claim 14, wherein said twisting means is a take-up spindle which applies a twist to said composite yarn as the composite yarn is formed into a yarn package.

* * * * *